United States Patent [19]

Strubel

[11] Patent Number: 5,060,667

[45] Date of Patent: Oct. 29, 1991

[54] SMOKING ARTICLE

[75] Inventor: David G. Strubel, Louisville, Ky.

[73] Assignee: Brown & Williamson Tobacco Corporation, Louisville, Ky.

[21] Appl. No.: 568,151

[22] Filed: Aug. 16, 1990

[51] Int. Cl.[5] ..... A24F 47/00

[52] U.S. Cl. ..... 131/271; 131/273; 131/359

[58] Field of Search ..... 131/359, 273, 270, 271, 131/272

[56] References Cited

U.S. PATENT DOCUMENTS

| | | | |
|---|---|---|---|
| 3,258,015 | 6/1966 | Ellis et al. | 131/273 |
| 4,340,072 | 7/1982 | Bolt et al. | 131/273 |
| 4,913,169 | 4/1990 | Templeton | 131/359 |

FOREIGN PATENT DOCUMENTS

| | | | |
|---|---|---|---|
| 0245732 | 11/1987 | European Pat. Off. | 131/369 |
| 0254848 | 2/1988 | European Pat. Off. | 131/359 |

*Primary Examiner*—V. Millin

*Assistant Examiner*—Lynne A. Reichard

*Attorney, Agent, or Firm*—Charles G. Lamb

[57] ABSTRACT

A smoking article includes a combustible fuel element circumscribed by a heat transfer tube with a flavor source material circumscribing the heat transfer tube. At the ignition or upstream end of the smoking article, an impervious annular flange is provided. The flange includes an opening therein substantially the same diameter and configuration as the inside diameter of the heat transfer tube and the outside diameter is substantially the same as that of the smoking article. The flavor source material is in flow communication with the downstream or the mouth end of the smoking article so that upon ignition of the combustible fuel element, smoke that is generated from the fuel element is prevented by the annular flange from coming into contact with the varporizing flavor being released by the flavor source material when the smoker draws on the smoking article. Only the vaporizing materials from the flavor source material is received by the smoker.

13 Claims, 1 Drawing Sheet

SMOKING ARTICLE

BACKGROUND OF THE INVENTION

1. Field of the Invention

The present invention relates to a smoking article. The present invention particularly relates to a smoking article having a central fuel element surrounded by a heat transfer tube with a flange on its end furthest from the smoker's mouth and sealed on its end closest to the smoker's mouth, thus preventing smoke from the fuel element from entering the smoker's mouth. A flavor source material saturated with a aerosol generating material and flavorants circumscribes the heat transfer tube and when heated the flavor source material releases the aerosol and flavorants for the smoker to enjoy.

2. Description of the Prior Art

Various so-called smokeless cigarettes which have tobacco products circumscribed by a fuel element are well known in the prior art. However, all of these articles allow some smoke from at least their fuel element to enter the smoker's mouth. For example, U.S. Pat. No. 3,258,015 teaches such an article having a heat conductive tubular member containing a nicotine-releasing material surrounded by a heating means. The heat conductive tubular member has a porous disc extending across its outer end furthest from the smoker's mouth. This porous disc prevents the nicotine-releasing material from being ignited, but will not prevent smoke from the heating means from being inhaled, particularly during lighting of the smoking article.

SUMMARY OF THE INVENTION

The present invention is for a smoking article wherein a flavor source material saturated with an aerosol-generating material and flavorants is heated by a fuel element contained in a heat transfer tube.

More particularly, the present invention is for a smoking article comprising: a combustible fuel element; a hollow heat transfer tube circumscribing said fuel element, said heat transfer tube having an upstream end and a downstream end, said heat transfer tube closed at its downstream end and open at its upstream end, said heat transfer tube having an annular flange at its upstream end, said flange having an outside diameter substantially the same as that of the smoking article; a flavor source material circumscribing said heat transfer tube; and a porous wrapper circumscribing the smoking article.

BRIEF DESCRIPTION OF THE DRAWINGS

A better understanding of the present invention will be had upon reference to the following description in conjunction with the accompanying drawings wherein.

DETAILED DESCRIPTION OF THE PREFERRED EMBODIMENT

Figure 1:
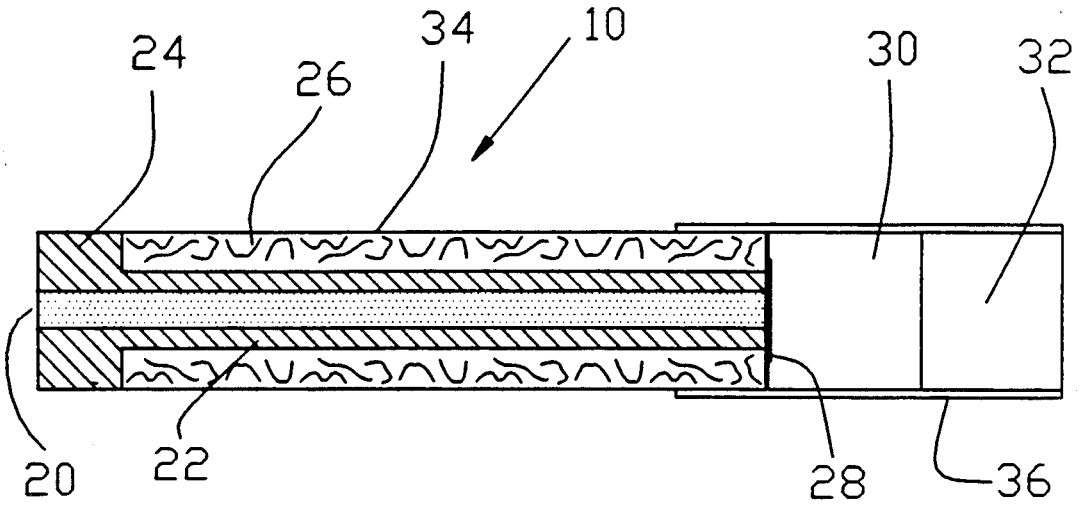
FIG. 1 is a cross-sectional view of the smoking article.

With reference to FIG. 1, there is shown a smoking article 10. The smoking article 10 contains a combustible fuel element 20 along the majority of its central longitudinal axis. The combustible fuel element 20 is contained in a hollow heat transfer tube 22, which is closed at the end closest to the smoker's mouth and open at the end furthest from the smoker's mouth. Heat transfer tube 22 has an annular flange 24 at the end furthest from the smoker's mouth. This annular flange 24 prevents smoke from the combustible fuel element 20 from entering the smoker's mouth, particularly during the lighting of the smoking article 10 as described hereinafter. Flange 24 has substantially the same diameter as the smoking article 10. Heat transfer tube 22 can be constructed of any inert metal which will conduct heat, such as, for example, copper or aluminum.

Heat transfer tube 22 is circumscribed by a flavor source material 26. The flavor source material 26 may be a material such as, for example, tobacco, reconstituted tobacco, or a porous substrate. Flavor source material 26 is saturated with an aerosol producer, such as, for example, glycerine, propylene glycol, and a flavoring material, such as, for example, menthol, tobacco extracts, oleo resins, spices and volatile acids such as citric acid.

The smoking article may have a porous disc 28 adjacent to the closed end of heat transfer tube 22 and transverse to the central longitudinal axis of the smoking article 10. Porous disc 28 has a diameter substantially the same as that of smoking article 10. Additionally, the smoking article 10 may have a mixing chamber 30 adjacent to the porous disc 28 and a filter 32 adjacent to the mixing chamber 30. If either the porous disc 28 or the mixing chamber 30 is not included, the smoking article may still have filter 32 added. Smoking article 10 has a porous cigarette paper 34 circumscribing it. Tipping paper 36 may circumscribe the mixing chamber and filter.

Figure 2A:
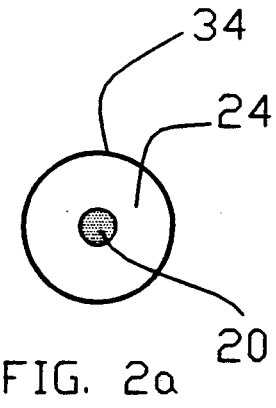
FIG. 2*a* is an end view of the smoking article showing the annularly flanged end of the heat transfer tube and the central combustible fuel element.
Figure 2B:
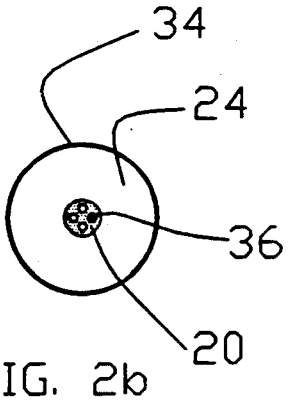
FIG. 2*b* is the same view as in FIG. 2*a*, except the fuel element contains air passages longitudinally extending therethrough.

Combustible fuel element 20 is contained in hollow heat transfer tube 22 which is closed at the end closest to the smoker's mouth. One means to ensure that combustible fuel element 20 will continue to burn after being ignited is shown in FIG. 2*a*. In FIG. 2*a*, combustible fuel element 20 is constructed of a material such as, for example, tobacco, a tobacco and carbon mixture, carbon, or charcoal. Combustible fuel element 20 also contains internal oxidizers such as, for example, potassium nitrate, manganese dioxide, and sodium nitrate, which cause fuel element 20 to burn until expended. A second means to ensure continued burning of combustible fuel element 20 is to provide at least one air passage longitudinally through element 20, as shown in FIG. 2*b*, instead of the use of internal oxidizers. The air passage allows enough oxygen for the fuel element 20 to burn until expended.

In operation, when the combustible fuel element 20 is ignited, the heat released therefrom heats the flavor source material 26 and vaporizes the aerosol generating substance in the flavor source material 26. As a smoker inhales or draws on the smoking article 10, ambient air is drawn along the flavor source material 26 and as it passes therethrough the air is heated and entrains the vaporized aerosol substance. The heated air, with the entrained aerosol substance, then passes from the smoking article 10 into the smoker's mouth. The flange 24, at the ignition or upstream end of the smoking article is disposed between the combustible fuel element 20 and the fuel source material 26 and thereby prevents smoke from entering the stream of air which is flowing through the flavor source material 26 and subsequently into the smoker's mouth.

The foregoing detailed description is given primarily for clearness of understanding and no unnecessary limitations are to be understood therefrom, for modifications can be made by those skilled in the art upon reading this disclosure, and may be made without departing from the spirit of the invention and scope of the appended claims.

What is claimed is:

1. A smoking article comprising:

a) a combustible fuel element;

b) a hollow heat transfer tube circumscribing said fuel element, said heat transfer tube having an upstream end and a downstream end, said heat transfer tube open at its upstream end and closed at its downstream end, said heat transfer tube having an annular flange at its upstream end, said flange having an outside diameter substantially the same as that of the smoking article and a centrally disposed opening in alignment with said combustible end element;

c) A flavor source material circumscribing said heat transfer tube and in fluid communication with a smoker's mouth; and d) a porous wrapper circumscribing the smoking article.

2. The smoking article of claim 1 further comprising a porous disc having an outside diameter substantially the same as that of the smoking article, said porous disc being adjacent to the downstream closed end of said heat transfer tube and transversely aligned in said smoking article.

3. The smoking article of claim 2 further comprising a filter rod adjacent to and downstream from said porous disc.

4. The smoking article of claim 3 including a mixing chamber disposed between said porous disc and said filter rod.

5. The smoking article of claim 1 wherein the fuel element contains internal oxidizers.

6. The smoking article of claim 5 wherein the internal oxidizers contained in said fuel element are selected from the group consisting of manganese dioxide, potassium nitrate, and sodium nitrate.

7. The smoking article of claim 1 wherein the fuel element contains at least one air passage longitudinally extending therethrough.

8. The smoking article of claim 1 wherein said flavor source material comprises tobacco saturated with an aerosol generating material.

9. The smoking article of claim 8 wherein said flavor source material includes a flavoring material.

10. The smoking article of claim 1 wherein said flavor source material comprises reconstituted tobacco.

11. The smoking article of claim 1 wherein said flavor source material comprises a porous substrate.

12. The smoking article of claim 8 wherein the aerosol generating material is selected from the group consisting of glycerine and propylene glycol.

13. The smoking article of claim 9 wherein the flavoring material is selected from the group consisting of spices, menthol, and tobacco extracts.

* * * * *